US008256195B2

(12) United States Patent
Pape

(10) Patent No.: US 8,256,195 B2
(45) Date of Patent: Sep. 4, 2012

(54) ICE BAGGING APPARATUS

(75) Inventor: Henrik Pape, Horsens (DK)

(73) Assignee: Schur Technology a/s, Horsens (DK)

( * ) Notice: Subject to any disclaimer, the term of this patent is extended or adjusted under 35 U.S.C. 154(b) by 299 days.

(21) Appl. No.: 12/583,652

(22) Filed: Aug. 24, 2009

(65) Prior Publication Data

US 2011/0041467 A1 Feb. 24, 2011

(51) Int. Cl.
*B65B 1/32* (2006.01)
*B65B 1/46* (2006.01)
*B65B 9/02* (2006.01)

(52) U.S. Cl. ..... 53/502; 53/553; 53/555; 53/568; 141/83

(58) Field of Classification Search ..... 53/127, 53/502–504, 548, 550–555, 568; 62/60, 62/137, 331, 344; 141/82, 83
See application file for complete search history.

(56) References Cited

U.S. PATENT DOCUMENTS

| | | | | | |
|---|---|---|---|---|---|
| 2,334,256 | A | * | 11/1943 | Eaton | 53/551 |
| 3,151,668 | A | * | 10/1964 | Zimmermann | 62/137 |
| 3,277,666 | A | * | 10/1966 | Simmons | 62/344 |
| 3,501,887 | A | * | 3/1970 | Umholtz et al. | 53/551 |
| 3,654,771 | A | * | 4/1972 | Kuebler | 62/352 |
| 3,712,019 | A | * | 1/1973 | Lamka et al. | 53/503 |
| 3,807,193 | A | * | 4/1974 | McKenney et al. | 53/127 |
| 3,918,266 | A | * | 11/1975 | Gindy et al. | 62/137 |
| 4,368,608 | A | | 1/1983 | Ray | |
| 4,689,937 | A | * | 9/1987 | Finan, Sr. et al. | 53/502 |
| 4,942,983 | A | * | 7/1990 | Bradbury | 222/238 |
| 5,088,300 | A | * | 2/1992 | Wessa | 62/344 |
| 5,109,651 | A | | 5/1992 | Stuart | |
| 5,277,016 | A | * | 1/1994 | Williams et al. | 53/502 |
| 5,440,863 | A | * | 8/1995 | Toya et al. | 53/502 |
| 5,473,865 | A | * | 12/1995 | Tanaka et al. | 53/502 |
| 5,630,310 | A | * | 5/1997 | Chadwell | 53/502 |
| 5,722,215 | A | * | 3/1998 | Yuyama | 53/550 |
| 5,832,700 | A | * | 11/1998 | Kammler et al. | 53/502 |
| 6,112,539 | A | * | 9/2000 | Colberg | 62/331 |
| 6,305,177 | B1 | * | 10/2001 | Edwards et al. | 62/344 |

(Continued)

FOREIGN PATENT DOCUMENTS

FR 2650559 A1 * 2/1991

(Continued)

OTHER PUBLICATIONS

EPO machine translation of FR 2650559, retrieved from http://translationportal.epo.org/emtp/translate/?Action=description-r...EP&NUMBER=2650559&OPS=ops.epo.org&TRGLANG=en&ENGINE=google&SRCLANG=fr, Oct. 11, 2011, 4 pages.*

(Continued)

*Primary Examiner* — Stephen F Gerrity
(74) *Attorney, Agent, or Firm* — James Creighton Wray

(57) ABSTRACT

An ice bagging apparatus which has a frame defining a first ice collecting zone with a collecting bin and an ice bagging zone, wherein the ice bagging zone has a film feeding mechanism that conveys two heat-sealable elongated plastic film webs and a welding apparatus to form a bag from the webs. The film feeding mechanism has rollers between which film webs are passed and pressed against each other. A measuring arrangement measures ice dispensed into the bag by a first ice transport system positioned between the two film webs that form the bag.

19 Claims, 10 Drawing Sheets

U.S. PATENT DOCUMENTS

| | | | | |
|---|---|---|---|---|
| 6,474,048 | B1 * | 11/2002 | Metzger et al. | 53/503 |
| 6,904,765 | B2 * | 6/2005 | Lee et al. | 62/344 |
| 7,062,892 | B2 * | 6/2006 | Metzger | 53/127 |
| 7,497,062 | B2 * | 3/2009 | Metzger | 53/58 |
| 7,681,408 | B2 * | 3/2010 | Hobson et al. | 62/137 |
| 7,806,152 | B2 * | 10/2010 | Dalton et al. | 53/502 |
| 7,849,660 | B2 * | 12/2010 | Metzger | 53/58 |
| 7,958,918 | B2 * | 6/2011 | Ladson | 141/82 |
| 7,992,364 | B2 * | 8/2011 | Thurgood et al. | 53/551 |
| 2004/0216481 | A1 * | 11/2004 | James et al. | 62/344 |
| 2005/0115210 | A1 * | 6/2005 | Noumi | 53/502 |

FOREIGN PATENT DOCUMENTS

| | | | |
|---|---|---|---|
| GB | 2011633 | A * | 7/1979 |
| JP | 05132007 | A * | 5/1993 |

OTHER PUBLICATIONS

JPO machine translation of JP 5-132007, retrieved from http://www4.ipdl.inpit.go.jp/Tokujitu/tjsogodbenk.ipdl, Oct. 12, 2011, 20 pages.*

* cited by examiner

ICE BAGGING APPARATUS

FIELD OF THE INVENTION

The present invention relates to an ice bagging apparatus for bagging discrete units of ice.

The present invention further relates to a combination of an ice making machine, an ice bagging apparatus, an ice storage compartment and an ice bag collector and distributor apparatus.

BACKGROUND OF THE INVENTION

An example of an ice bagging apparatus is disclosed in U.S. Pat. No. 4,368,608. This apparatus comprises an ice maker, which is placed above an ice collecting and bagging zone, and wherein the ice maker dispenses ice directly into a bag. This causes condensate to enter some of the ice bags during filling when the ice maker has completed a defrost cycle.

A disadvantage of this is that the water freezes the ice cubes together into bigger solid blocks, which is not desired by the end customer of the ice cubes.

Another example of an ice bagging apparatus is disclosed in U.S. Pat. No. 5,109,651. This apparatus comprises an ice collecting zone and an ice bagging zone. The ice collecting zone is a funnel shaped structure. The ice collected in the ice collecting zone is conveyed to the ice bagging zone through an upwardly directional auger in a tube. The ice is delivered to a plastic bag below a terminal end of the chute, said plastic bag being held into position within the ice bagging zone, and supplied from a stack of bags, by a tractor. The filled bag is placed in a distribution compartment.

OBJECT OF THE INVENTION

It is the object of the invention to provide an improved ice bagging apparatus. In one aspect the ice bagging apparatus may provide ice filled bags without being adversely affected by the defrost cycle of the ice maker.

DESCRIPTION OF THE INVENTION

According to one aspect the present invention, this is achieved by an ice bagging apparatus comprising:

a) a frame, b) a first ice collecting zone within said frame comprising a collecting bin;

c) an ice bagging zone within said frame comprising

- i) a film feeding mechanism for conveying two superposed heat-sealable elongated film webs of plastic from a film web stock according to a conveying direction, and
- ii) a welding apparatus for joining said two film webs to form a bag, d) a first ice transport system within said frame, having an inlet opening in the first ice collecting zone and an outlet opening in the ice bagging zone and positioned between the two film webs above the formed bag, and e) a measuring arrangement within said frame for measuring the amount of ice dispensed into the bag by the first ice transport system.

It is further achieved by an ice bagging apparatus comprising:

a) a first ice collecting zone comprising a first collecting bin;

b) a second ice collecting zone comprising a second collecting bin;

c) an ice bagging zone comprising

- i) a film feeding mechanism for conveying two superposed heat-sealable elongated webs of film from a film stock according to a conveying direction, and

- ii) a welding apparatus for joining said two film webs to form a bag, c) a first ice transport system, having an inlet opening in the first ice collecting zone and an outlet opening in the ice bagging zone and positioned between the two webs of film above the formed bag, d) an upwardly directional second ice transport system, having an inlet opening in the second ice collecting zone and an outlet opening in first collection zone, and e) a measuring arrangement for measuring the amount of ice dispensed into the bag by the first ice transport system.

It is further achieved by a combination comprising:

an ice making machine;

an ice bagging apparatus comprising:

a) a frame, b) a first ice collecting zone within said frame comprising a collecting bin;

c) an ice bagging zone within said frame comprising

- i) a film feeding mechanism for conveying two superposed heat-sealable elongated film webs of plastic from a film web stock according to a conveying direction, and
- ii) a welding apparatus for joining said two film webs to form a bag, d) a ice transport system within said frame, having an inlet opening in the first ice collecting zone and an outlet opening in the ice bagging zone and positioned between the two film webs above the formed bag, and e) a measuring arrangement within said frame for measuring the amount of ice dispensed into the bag by the ice transport system, an ice bag storage compartment, and an ice bag collector and distributor apparatus.

It is further achieved by a combination comprising:

an ice making machine;

an ice bagging apparatus comprising:

a) a first ice collecting zone comprising a first collecting bin;

b) a second ice collecting zone comprising a second collecting bin;

c) an ice bagging zone comprising

- i) a film feeding mechanism for conveying two superposed heat-sealable elongated webs of film from a film stock according to a conveying direction, and
- ii) a welding apparatus for joining said two film webs to form a bag, c) a first ice transport system, having an inlet opening in the first ice collecting zone and an outlet opening in the ice bagging zone and positioned between the two film webs above the formed bag, d) a second ice transport system, having an inlet opening in the second ice collecting zone and an outlet opening in first collection zone, and e) a measuring arrangement for measuring the amount of ice dispensed into the bag by the first ice transport system, an ice bag storage compartment, and an ice bag collector and distributor apparatus.

In the present application the term "ice" is used for discrete units of ice, such as ice cubes, crushed ice, and granular ice flakes.

It is herewith achieved that blocks of ice frozen together by water originating from defrosting of an ice supply which may be an ice making machine is transported forward within the inlet of ice the transport system inside the collecting bin until it meets the forward wall of the collecting bin. The block of ice is pinned between the ice transport system and the forward wall and crushed into smaller pieces, with an acceptable size.

According to a first aspect of the invention the first ice transport system is a downwardly directional ice transport system. It is herewith achieved that ice from the ice maker is transported forward aided by gravity within the inlet of the ice transport system.

Furthermore the downwardly directional first ice transport system consumes less energy than an upwardly directed ice transport system, because the movement of ice towards the ice bagging zone is aided by gravity.

According to a further aspect of the invention the second ice transport system may be upwardly directional. Hereby it is possible to minimize the risk that water is introduced into the first collection zone during the defrost cycle of the ice supply.

According to a further aspect of the invention the first ice transport system may be upwardly directional. Hereby it is possible to minimize the risk that water is introduced into the bag during the defrost cycle of the ice supply.

According to a further aspect of the invention the first ice transport system may be horizontal. Hereby it is possible to minimize the risk that water or ice is introduced unintentionally into the bag during the defrost cycle of the ice supply.

The frame may be a structure covered by plates or a monocoque construction. The various parts of the ice bagger are supported by the frame either directly or indirectly through other parts connected to the frame.

The ice collecting zone is placed below an ice supply, which may be an ice making machine, that are dropping ice directly into the ice collecting zone. The ice collecting zone is a collecting bin, such that the ice will gather at a central position at the bottom of the collecting bin and the ice collecting zone may be completely emptied.

According to a specific embodiment the collecting bin comprises a funnel shaped structure.

The first ice transport system is provided for conveying the ice from the ice collecting zone and into the ice bagging zone. The first ice transport system has an inlet opening in the ice collecting zone and an outlet opening in the ice bagging zone.

In the ice bagging zone the bag to be filled is provided by two superposed heat-sealable elongated film webs of plastic provided by a film feeding mechanism and from a film web stock. The film webs are joined together for the formation of a bag by a welding apparatus.

The outlet opening of the first ice transport system is positioned between the two film webs. Ice dispensed from the first ice transport system is collected in the ice bag at a level below the outlet. A transverse welding seam across the film webs and a longitudinal connection of the two film webs at either sides extending over at least part of the length of the bag is created by the welding apparatus prior to filling ice into the bag.

It is preferred that the two film webs when forming the bag and when filling the bag with ice are provided in the upper part of the ice collecting zone where freezing occurs which decreases melting of the ice.

A measuring arrangement is continuously measuring the amount of ice dispensed by the first ice transport means into the bag. The measuring arrangement may be an optical sensor, a timer, a scale or a combination.

When the desired level has been detected by the measuring arrangement the sealing of the bag is completed by the welding apparatus, such that the bag is hermetically sealed.

The two superposed film webs may be joined at one side forming an U-shaped web prior to entering the film web stock, such that only one side needs welding in the ice bagging apparatus.

To increase the capacity of the ice bagging machine it is advantageous to use an ice making machine with a second ice supply. Therefore a second ice collecting zone may be provided for receiving ice being dispensed from the second ice supply.

The second ice collecting zone is a collecting bin similar to the first ice collecting zone. A second ice transport means is conveying the ice from the second ice collecting zone to the first ice collecting zone, where the ice is conveyed through the first ice transport means to the bag as described previously. The second ice transport system is preferably upwardly directional.

The second ice transport means has an inlet opening in the second ice collecting zone and an outlet opening in the first ice collecting zone.

The ice making machine used in the combination may be a commercially available ice maker, such as e.g. a Hoshizaki SAH-1300 manufactured by Hoshizaki America, Inc.

The ice bag storage compartment used in the combination may be a commercially available aisle freezer, such as freezers manufactured by e.g. Leer or Hussmann.

The ice bag collector and distributor apparatus used in the combination may be an apparatus and a method as described in concurrently filed US patent application with the title of "Method and Apparatus for Distributing Articles in a Storage Compartment", the content of which is hereby incorporated by reference.

In an alternative embodiment of the invention further ice makers are provided and further ice collecting zones are provided adjacent to and in communication with the first and/or second ice collecting zones by ice transport means, which are preferably upwardly directional. All ice is collected in the first ice collecting zone before being dispensed into the bag.

According to an embodiment of the invention, the ice bagging apparatus is new in that, the first and/or second ice transport means comprise a chute, a drive spring positioned inside said chute along the axis thereof, and a drive spring drive motor. The ice transport means are also referred to as the ice transport system.

It is herewith achieved to provide an apparatus with a simple, sanitary and reliable means of transporting the ice from the ice collecting zone to the ice bagging zone.

The drive spring may be left-handed or right-handed.

The drive spring will be easy to clean. According to a preferred embodiment the drive spring is centerless. Moreover the spring is manufactured from one thread with no welds and no joints. The surface of the spring will be smooth. These features help eliminate bacteria build up and makes it easier to clean the spring.

According to an embodiment of the invention, the ice bagging apparatus is new in that the drive spring is a helical spring.

It is herewith achieved that the drive spring is able to crush lumps comprising multiple ice cubes sticking together as a result of defrosting. The lump is pinned between the helical spring and the structure of the ice colleting zone prior to entering the chute. The drive spring motor will then build up energy in the spring, by deforming it axially and radially until the energy stored in the spring reaches a level which is sufficiently high to break the ice lump into smaller pieces, which are then able to enter the chute.

The build up of torque in the drive spring motor for a helical spring drive spring is gradual in contrast to a screw drive spring, where the torque built up is near instant, because a screw drive spring generally is stiff.

The material for the helical spring is stainless spring steel wire according to European norm EN10270-3.

According to an embodiment of the invention, the ice bagging apparatus is new in that at least one drain opening is formed at substantially the lowest position of the chute, and wherein a drip pan is provided underneath said at least one drain opening.

It is herewith achieved that water melted off the ice cubes inside the chute are collected in the drip pan. Any water condensing on the outside of the chute may also be collected in the drip pan.

In an alternative embodiment of the invention the chute is provided with a plurality of drain openings along its length.

The drip pan may advantageously be connected to a drain chute for continuously emptying the drip pan.

The drain holes will ensure that water melted off the ice cubes will be removed from the chute and go into the drip pan. Hereby it is ensured that ice without melted water is put into the bagging zone and into the bags. Moreover the combination of an inclined chute the spring and the drain holes is beneficial in eliminating the water off of the ice cubes and as a benefit dryer ice cubes are transferred to the bags.

According to an embodiment of the invention, the ice bagging apparatus is new in that the film feeding mechanism comprises a pair of rollers between which the film webs are passed, means for pressing the rollers against each other for retaining the film webs there between, and a film feeding motor operationally connected to the at least one of the rollers.

It is herewith achieved to provide a film feeding mechanism which is simple and reliable. Furthermore it is achieved to provide a film feeding mechanism with which the film webs may be controllably advanced or retracted in the conveying direction according to the direction in which the rollers are being turned by the film feeding motor.

According to an embodiment of the invention, the ice bagging apparatus is new in that the welding apparatus comprises means for performing thermal sealing, the means being disposed at a position after the rollers as seen in the conveying direction of the film webs.

It is herewith achieved that the two film webs are joined by thermal sealing. The means for performing thermal sealing may e.g. be welding jaws that are reciprocatingly moved into and out of contact with the film webs.

According to an embodiment of the invention, the ice bagging apparatus is new in that the welding apparatus comprises means of thermal sealing on the film webs both in direction across and along the conveying direction.

It is herewith achieved to provide an apparatus which is capable of formation of bags with a closed compartment for the ice from a roll of film webs.

Firstly a transverse thermal sealing is performed. Then the film web is advanced intermittently or continuously while a longitudinal thermal sealing along the conveying direction is performed. Simultaneously or subsequent to the completion of the longitudinal sealing the bag is filled with ice by operation of the first ice transport means. When the bag filling is completed a further transverse sealing to close the bag is performed.

The longitudinal sealing may be performed in one or more steps.

The means for performing thermal sealing may e.g. be welding jaws that are reciprocatingly moved into and out of contact with the film webs.

Alternatively, heated rollers may be used which perform a longitudinal heating/thermal sealing of the two webs to each other along the conveying direction.

According to an embodiment of the invention, the ice bagging apparatus is new in that the welding apparatus comprises means for separating the ice filled bag from the film webs.

The means for separating the ice filled bags may be a heated jaw or thread integrated with the welding jaws such that the ice filled bag is sealed and separated from the film web and simultaneously a transversal seal of one end of the next bag is performed.

Alternatively the means for separating the bag from the film web may be a knife, cutting through the two film webs.

During separation of the ice filled bag it is important that the bag is supported either by means within the welding apparatus, an external gripper or a platform supporting the bottom of the bag. Otherwise the cut may not be straight.

According to an embodiment of the invention, the ice bagging apparatus is new in that the measuring arrangement comprises a weighing scale which includes a base and a weighing pan, wherein the base is attached to the frame, and wherein the pair of rollers are suspended from the weighing pan.

It is herewith achieved that the amount of ice dispensed by the first ice transport system into the ice bag may be measured by weight. As the value of the ice may be settled by weight it is advantageous to measure the weight during filling and verify the weight of the filled bag.

The weighing scale may be an electro mechanical scale coupled to the controller of the first ice transport system, for controlling the dispensing of ice to the bag.

According to an embodiment of the invention, the ice bagging apparatus is new in that the measuring arrangement comprises a strain gauge scale which is interconnected between the frame and the pair of rollers.

It is herewith achieved that the amount of ice dispensed by the first ice transport system into the ice bag may be measured by weight. As the value of the ice may be settled by weight it is advantageous to measure the weight during filling and verify the weight of the filled bag.

The strain gauge scale is an electric scale coupled to the controller of the first ice transport system, for controlling the dispensing of ice to the bag. A strain gauge scale is very reliable and durable because it has no moving parts.

DESCRIPTION OF THE DRAWINGS

The invention will be explained in more detail below with reference to the accompanying drawing, where.

DETAILED DESCRIPTION OF THE INVENTION

In the explanation of the Figures, identical or corresponding elements will be provided with the same designations in different Figures. Therefore, no explanation of all details will be given in connection with each single FIGURE/embodiment.

Figure 1:
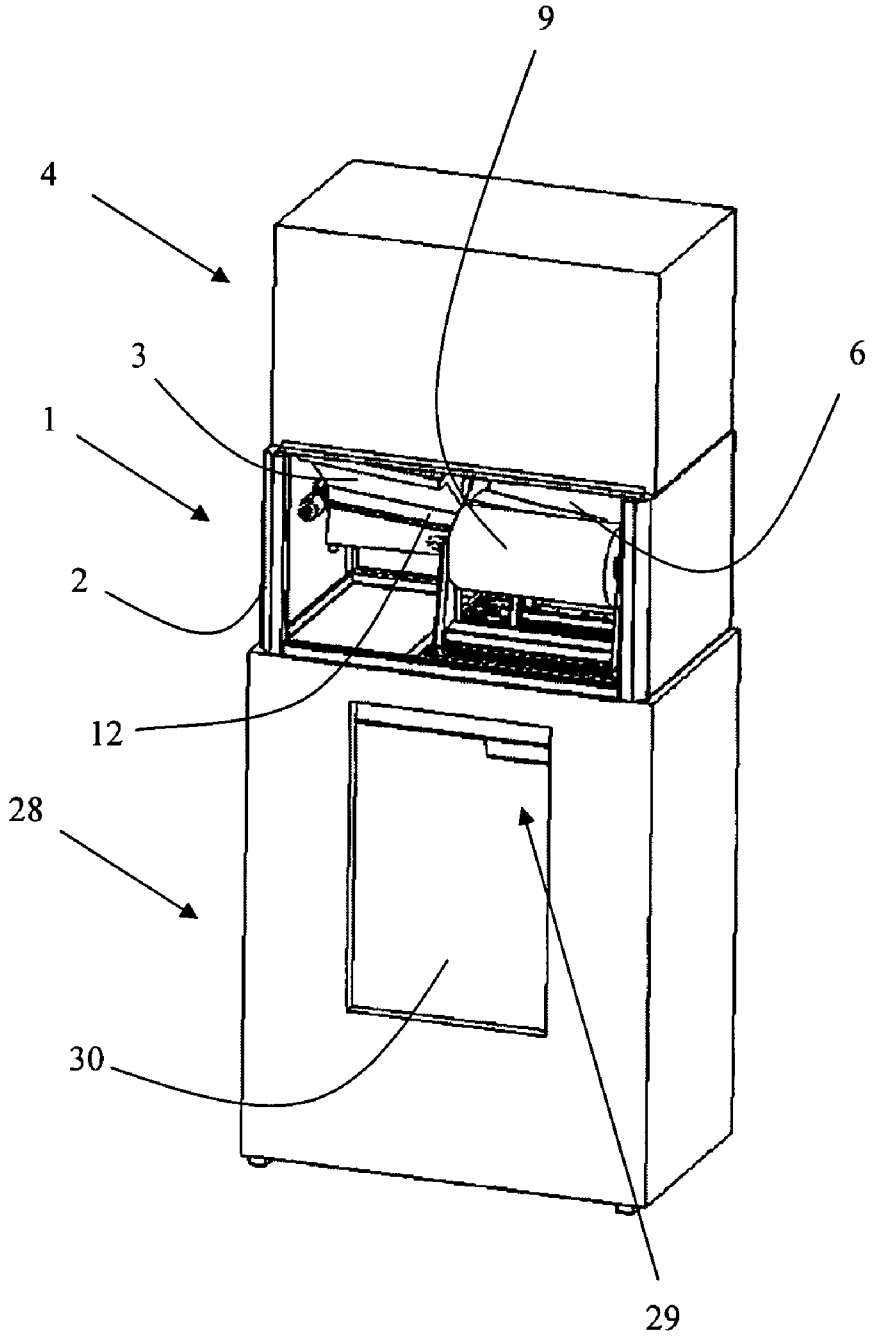
FIG. 1 shows a view of an ice distribution machine with an ice bagger comprising a single ice collecting zone.

FIG. 1 shows an ice bagging apparatus 1 in combination with an ice making machine 4, an ice bag storage compartment 28 and an ice bag collector and distributor apparatus 29. Ice is produced in the ice making machine 4 and dropped into the first ice collecting zone 3 from where it is conveyed to the ice bagging zone 6 through a first ice transport means 12. The ice is dispensed into a bag formed by two superposed heat sealable elongated film webs 8 (see FIGS. 4-10) of plastic film from a film web stock 9. The bag is sealed by a welding apparatus 20 (see FIGS. 5-8) and subsequently placed in an ice bag storage compartment 28 by an ice bag collector and distributor apparatus 29.

All parts of the ice bagging apparatus 1 are supported directly or indirectly by the frame 2.

The ice bags in the ice bag storage compartment 28 are accessible through a door 30 which may be opened by the customer for picking up an ice bag.

Figure 2:
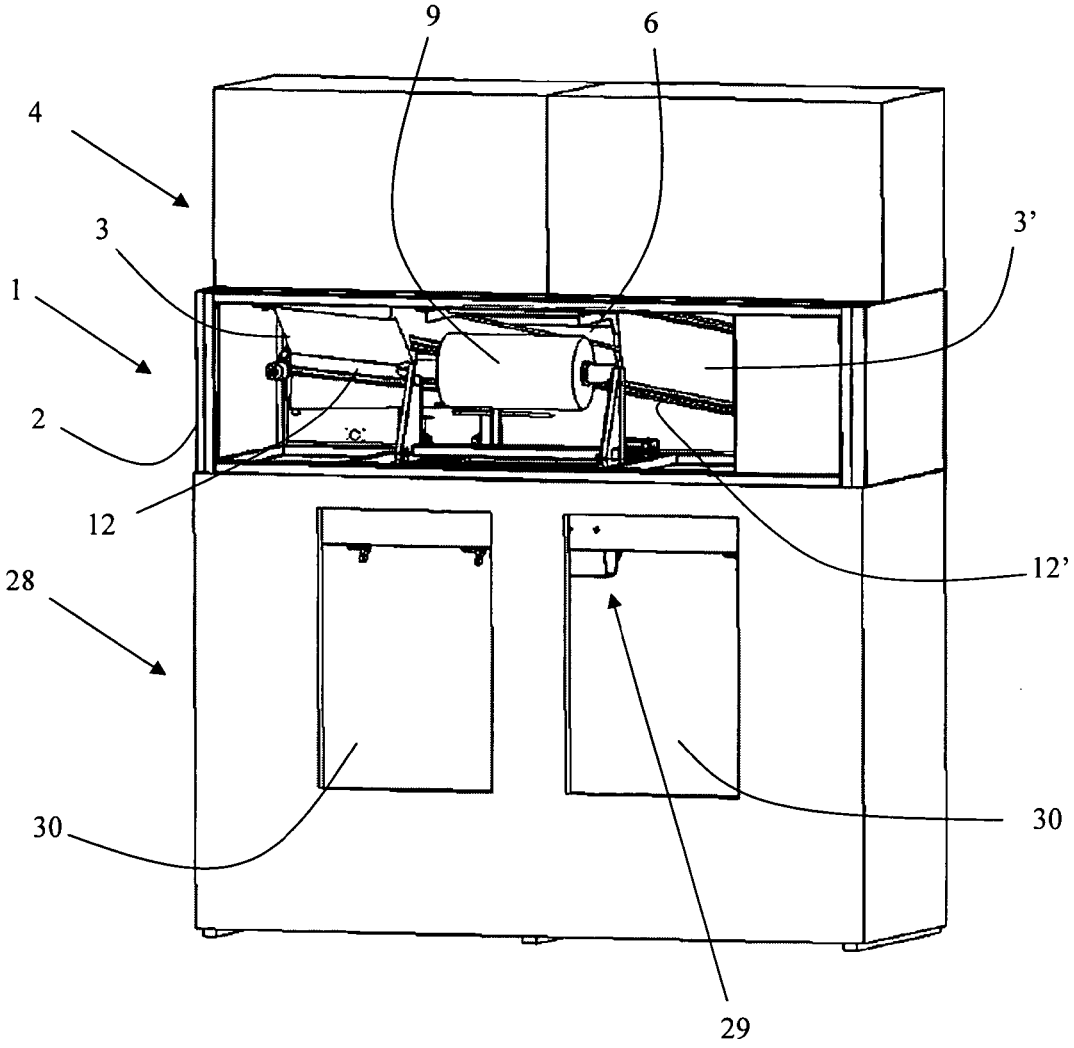
FIG. 2 shows a view of an ice distribution machine with an ice bagger comprising two ice collecting zones.

FIG. 2 shows the ice bagging apparatus 1 in combination with two ice making machine 4, an ice bag storage compartment 28 and an ice bag collector and distributor 29.

In the embodiment shown in FIG. 2 the ice bagging apparatus 1 comprises a first ice collecting zone 3 and a second ice collecting zone 3'. An ice making machine 4 is placed above each of the ice collecting zones 3, 3'. The ice produced in the ice making machines 4 is dropped into the ice collecting zones 3, 3'. The ice dropped into the second ice collecting zone 3' is conveyed by a second ice transport means 12' to the first ice collecting zone, where the supply from the second ice collecting zone 3' is combined with the ice dropped into the first ice collecting zone 3. The ice is then conveyed into an ice bagging zone 6 by a first ice transport means 12. The ice is dispensed into a bag formed by two superposed heat sealable elongated film webs 8 (see FIGS. 4-10) of plastic film from a film web stock 9. The bag is sealed by a welding apparatus 20 (see FIGS. 5-8) and subsequently placed in an ice bag storage compartment 28 by an ice bag collector and distributor apparatus 29.

The ice bags in the ice bag storage compartment 28 are accessible through doors 30 which may be opened by the customer for picking up an ice bag.

Figure 3:
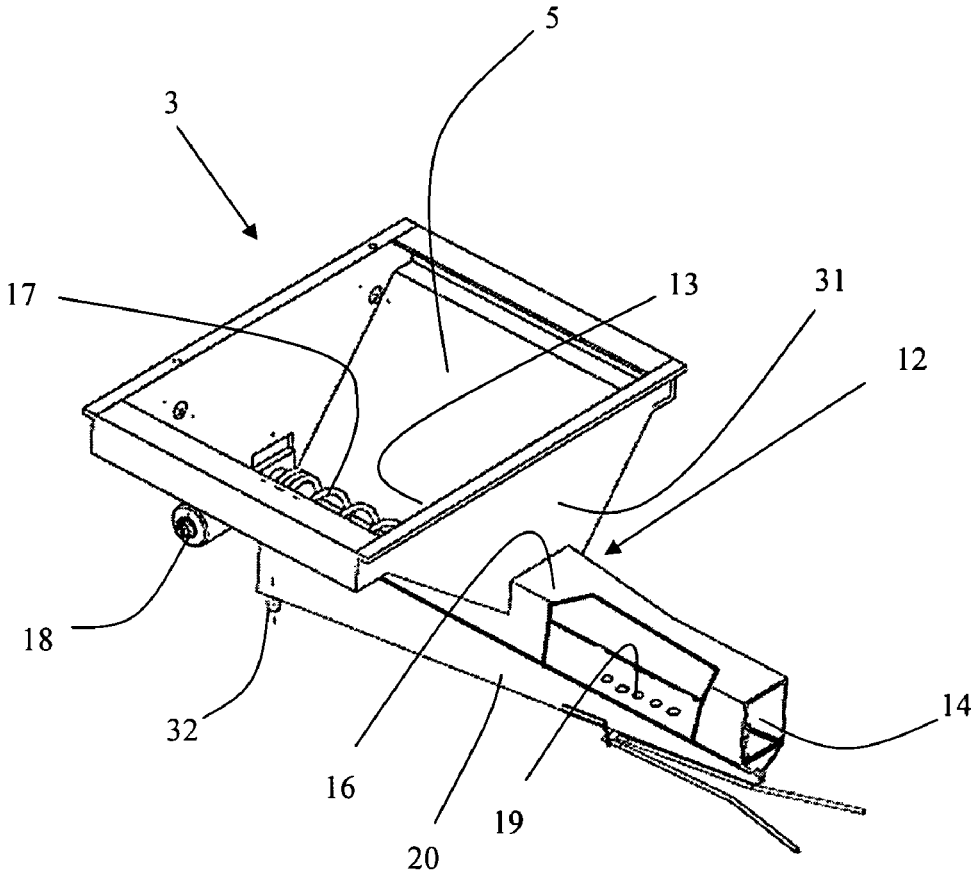
FIG. 3 shows a first isometric view of the first ice collecting zone and the first ice transport system.

FIG. 3 shows the first ice collecting zone 3 which is a collecting bin 5 such that the ice collected by the ice collecting zone 3 is gathered at the inlet opening 13 to the first ice transport means 12. The first ice transport means 12 is downwardly directional towards the ice bagging zone 6 (see FIGS. 4-10). The conveying of ice towards the outlet opening 14 is thereby aided by gravity. Alternatively the first ice transport means 12 may be horizontal or upwardly directional.

Ice which is frozen together by water from the defrost process of the ice making machine 4 and forming bigger lumps will move towards the ice bagging zone 6. The lump will be pinned against the first ice transport means 12 and a wall 31 of the collecting bin 5 aided by gravity and thereafter crushed into smaller pieces which may be conveyed into the ice bag.

In the embodiment shown in FIG. 3 the first ice transport means 12 comprises a chute 16 and drive spring 17 positioned inside the chute 16 along the axis thereof. The drive spring 17 extends to the outlet opening. The drive spring 17 is driven by an drive spring drive motor 18. The drive spring drive motor 18 is controlled by a controller for the machine (not shown) which is communicating with the measuring arrangement 15 (see FIG. 5).

In the embodiment shown in FIG. 3 the drive spring 17 is a helical spring.

In FIG. 3 a cut-out in the chute 16 shows five drain openings 19 formed along the bottom of the chute 16 (the drive spring 17 is not shown in the cut-out for clarity). Underneath the chute 16 a drip pan 20 is provided for collecting water drained by the drain openings 19. Alternative embodiments may have fewer or more drain openings 19. The condensed water, which is collected in the drip pan 20 may be removed from the drip pan 20 by a drain chute connected to a fitting 32 on the drip pan 20.

Figure 4:
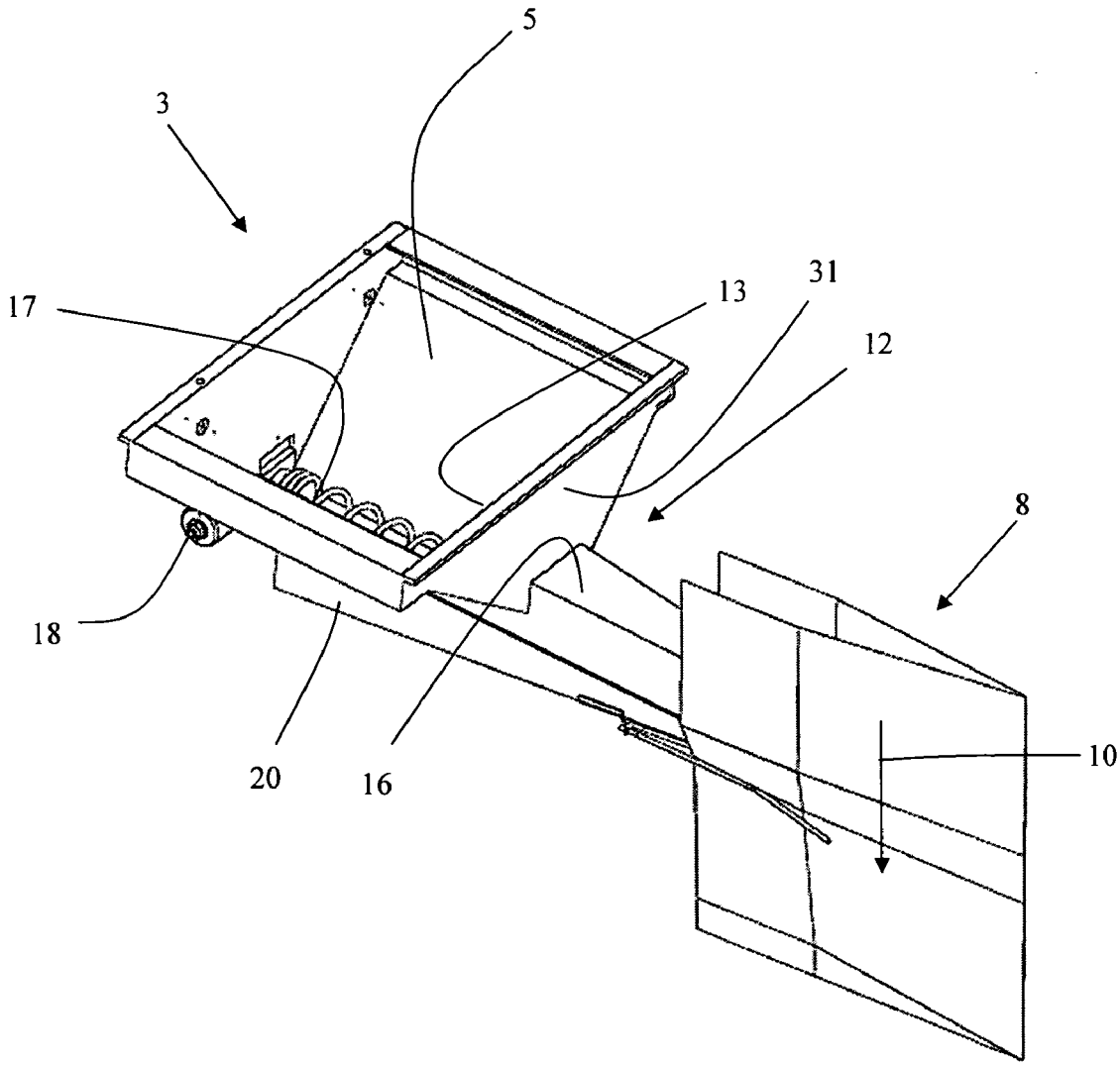
FIG. 4 shows a second isometric view of the first ice collecting zone with the outlet from the first ice transport system between the two webs.

FIG. 4 shows the first ice collecting zone 3 and a first ice transport means 12. The outlet opening 14 (see FIG. 3) of the first ice transport means 12 is located between the two layers of film webs 8. The bottom end of the film webs according to the conveying direction 10 is welded together by a welding apparatus 11 (see FIG. 5) to form a bag. The ice is dispensed by the first ice transport means 12 through the outlet opening 14 (see FIG. 3) into the bag.

It occurs from FIG. 4 in combination with FIG. 1 and FIG. 2 that the two film webs 8 (see FIGS. 4-10) when forming the bag and when filling the bag with ice is provided in the upper part of the ice bag storage compartment 28 where freezing occurs which decreases melting of the ice.

FIGS. 5-8 show the first ice collecting zone 3 and the ice bagging zone 6 comprising a film feeding mechanism 7 for conveying two superposed heat sealable elongated film webs 8 of plastic from a film web stock 9 according to the conveying direction 10 and a welding apparatus 11 for joining said two film webs 8 to form a bag.

The welding apparatus 11 comprises means 23 for performing thermal sealing. In the embodiment shown in FIG. 5 the means for performing thermal sealing are welding jaws. In the embodiment shown in FIG. 5 the means 23 for performing thermal sealing are able to seal the film webs 8 in a direction across and along the conveying direction 10. The welding jaws are reciprocally driven by a welding jaws drive motor 34 between a position where the jaws are in contact with the film webs 8 and a position away from the film web 8.

Figure 5:
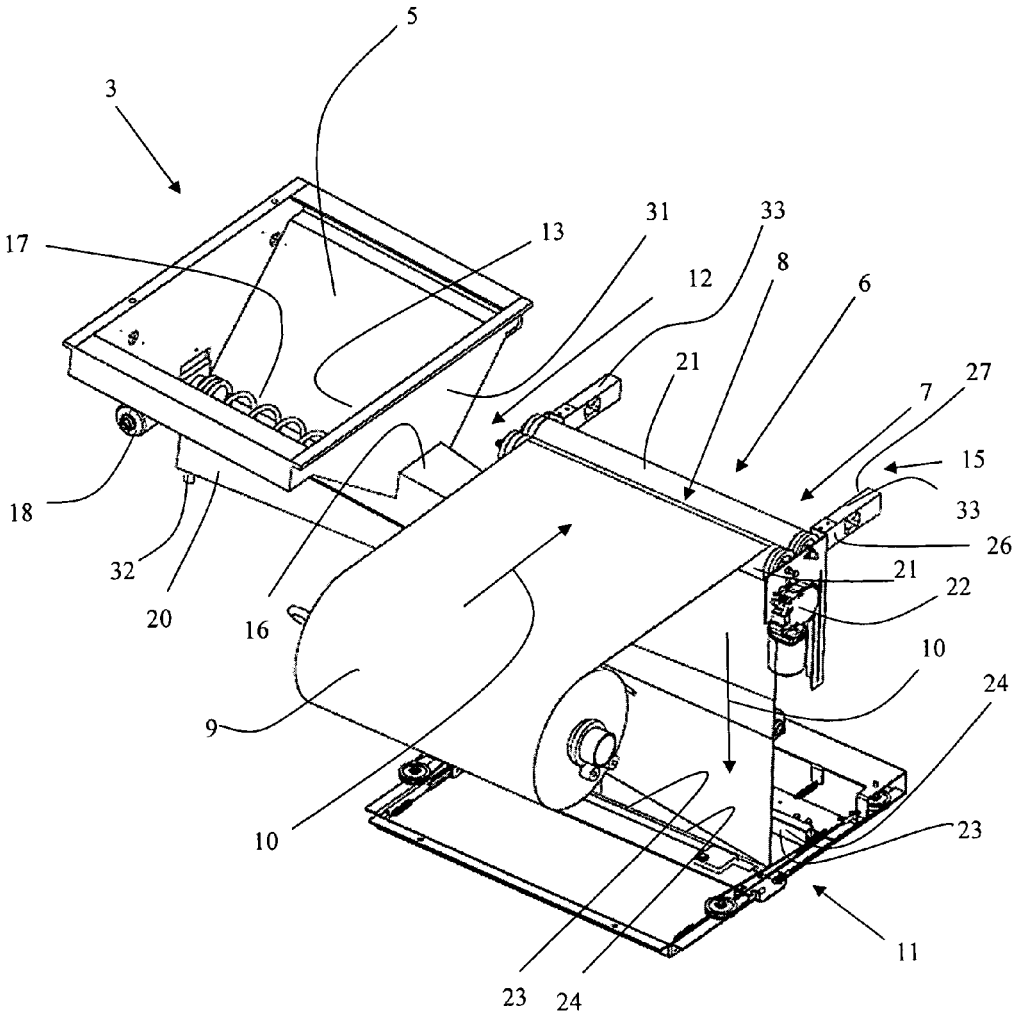
FIG. 5 shows a third isometric view of the first ice collecting zone and film feeding mechanism, the welding apparatus and the measuring arrangement.
Figure 6:
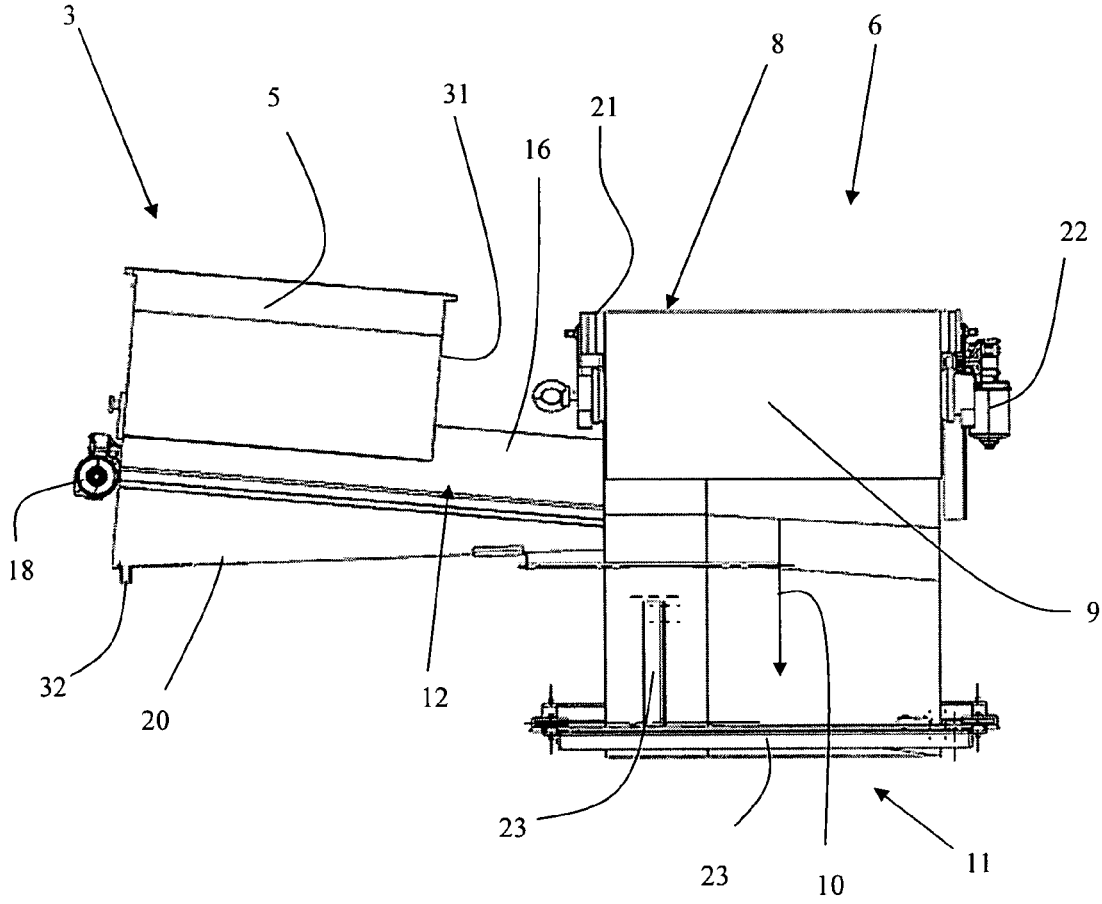
FIG. 6 shows a first side view of the first ice collecting zone and the bagging zone.
Figure 7:
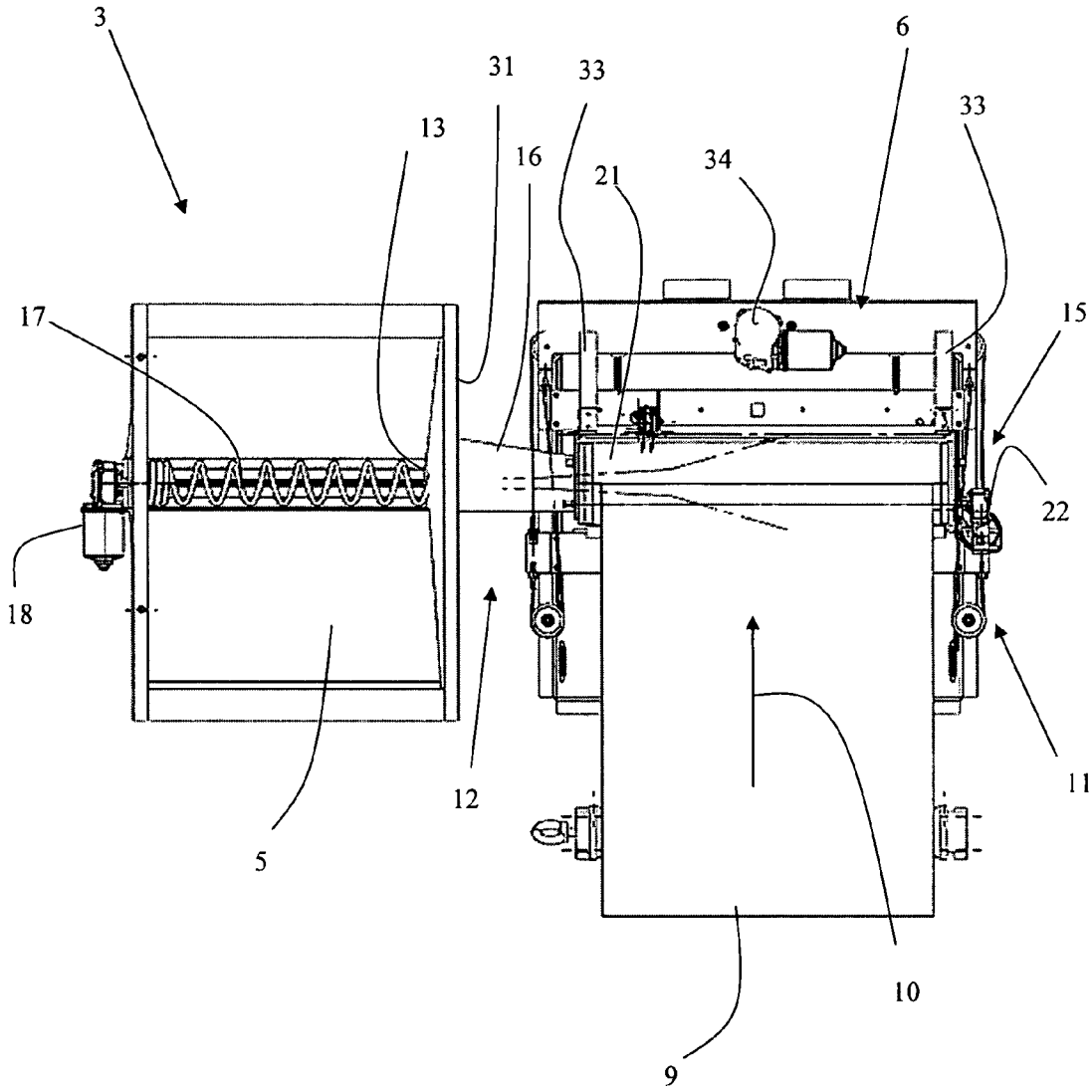
FIG. 7 shows a plan view of the first ice collecting zone and the bagging zone.
Figure 8:
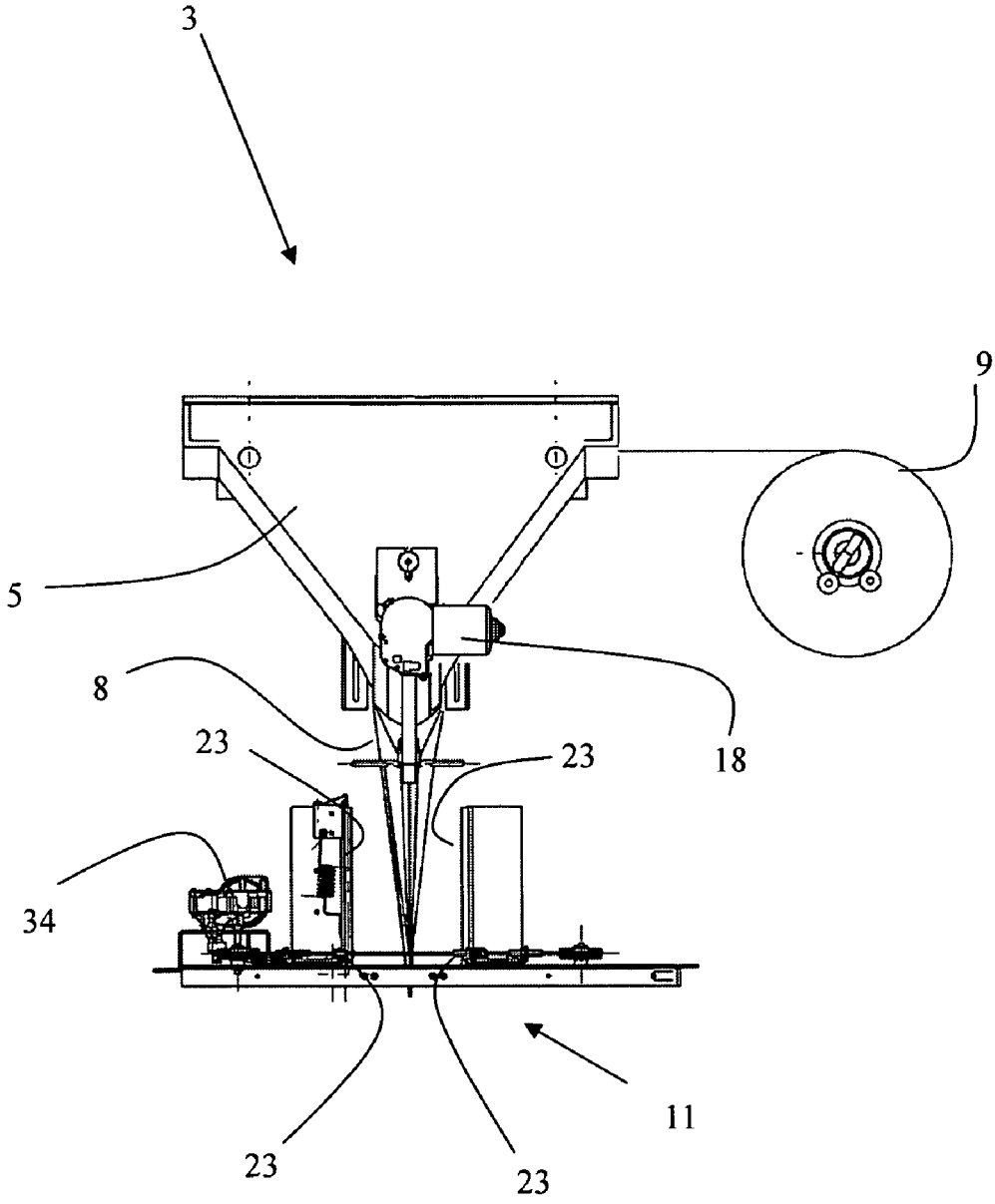
FIG. 8 shows a second side view of the first ice collecting zone and the bagging zone.

In the embodiment shown in FIGS. 4 and 5 the film webs 8 are joined together at one side such that the film webs are a U-shaped foil. The longitudinal thermal seal along the conveying direction 10 is performed by the means 23 of thermal sealing in steps while the film webs 8 are conveyed stepwise forward 10. When the bag is completely filled the bag is sealed across the conveying direction 10 by the means 23 of thermal sealing.

Concurrently the filled ice bag is separated from the film web by means 24 for separating the ice filled bag within the welding apparatus 11. It is preferred that these means 24 will be provided in form of a heated jaw or a heated thread which establish the separation by melting the film webs. Alternatively a cutting edge may be used.

The film feeding mechanism 7 comprises a pair of rollers 21 between which the film webs 8 are passed. Means for pressing the rollers against each other for retaining the film webs there between are provided by a spring. The rollers 21 are rotated by a film feeding motor 22 which is operationally connected to one of the rollers. The other roller is free wheeling and rotating by contact with the driven roller. The film web stock 9 is a roll which is replaceable by a full roll when the current roll is empty.

A measuring arrangement 15 is provided for measuring the amount of ice dispensed into the bag by the first ice transport means 12. In the embodiment shown in FIG. 5 the measuring arrangement provides a strain gauge scale 33 which is interconnected between the frame 2 (see FIGS. 1 and 2) and the pair of rollers 21. Thus the amount of ice dispensed by the first ice transport means 12 may be measured for controlling the weight of the filled ice bag.

In an alternative embodiment the measuring arrangement 15 comprises a weighing scale which includes a base and a weighing pan 26 wherein the base 27 is attached to the frame and wherein the pair of rollers 21 is suspended from the weighing pan 26.

Figure 9:
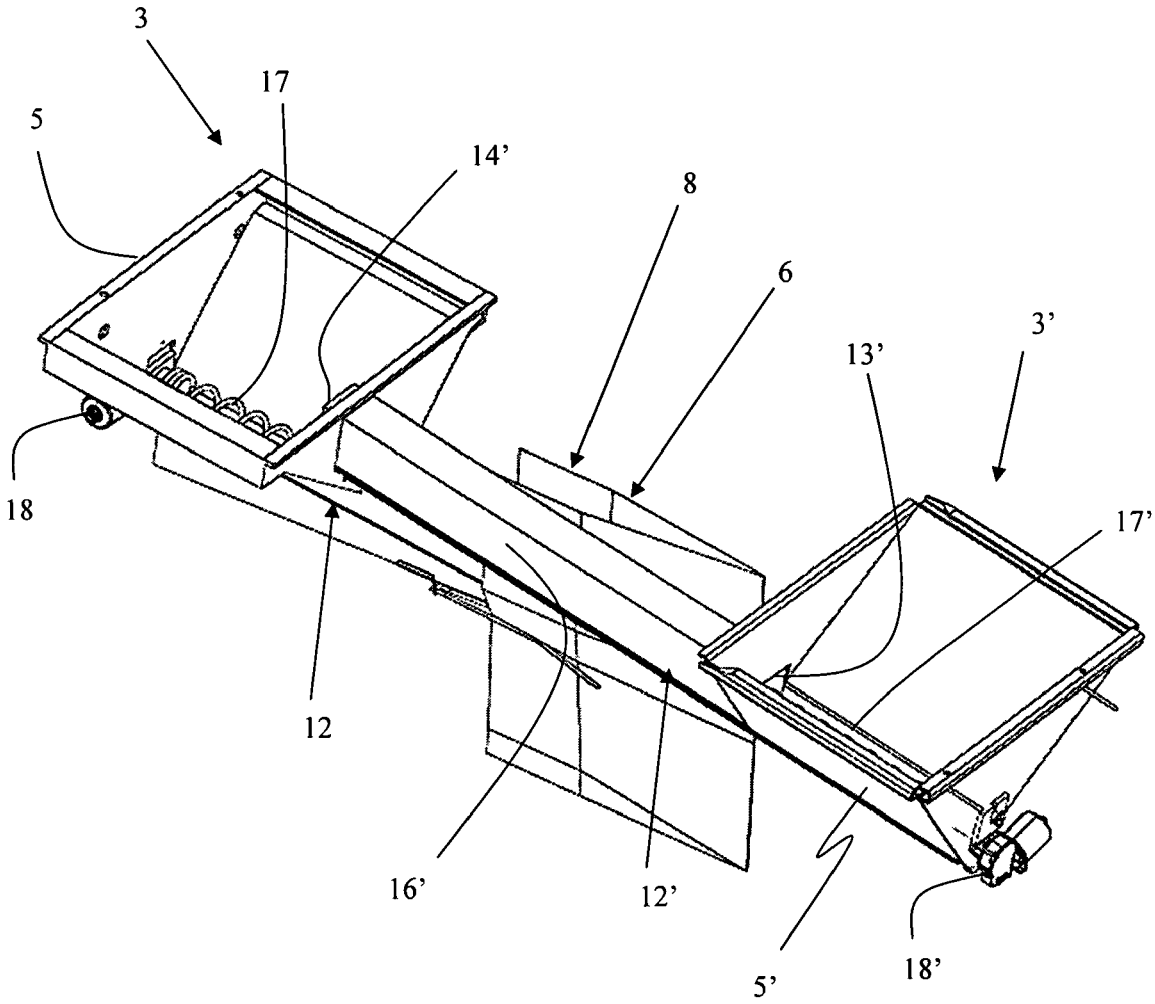
FIG. 9 shows an isometric view of the first and second ice collecting zones and the bagging zone in an ice bagger comprising two ice collecting zones.

FIG. 9 shows an embodiment with a first ice collecting zone 3 and a second ice collecting zone 3'. To increase the capacity of the ice bagging apparatus 1 a second ice collecting zone 3' is added to the ice bagging apparatus 1. The second ice collecting zone 3' comprises a collecting bin 5' for collecting ice dispensed by the ice maker 4 (see FIG. 2) located above the second ice collecting zone 3'. The second ice collecting zone 3' has an upwardly directional second ice transport means 12'. The second ice transport means 12' has an inlet opening 13' in the second ice collecting zone 3' and an outlet opening 14' in the first ice collecting zone 3. Ice collected in the second ice collecting zone 3' is thus conveyed by the second ice transport means 12' to the first ice collecting zone 3 where all the ice is collected prior to being conveyed by the first ice transport means 12 to the ice bagging zone 6 and dispensed into a bag formed by welding two film webs 8 together.

In the embodiment shown on FIG. 9 the second ice transport means 12' comprises a chute 16' and a drive spring 17' positioned inside said chute along the axis thereof and a drive spring drive motor 18'. The drive spring 17' is a helical spring.

Figure 10:
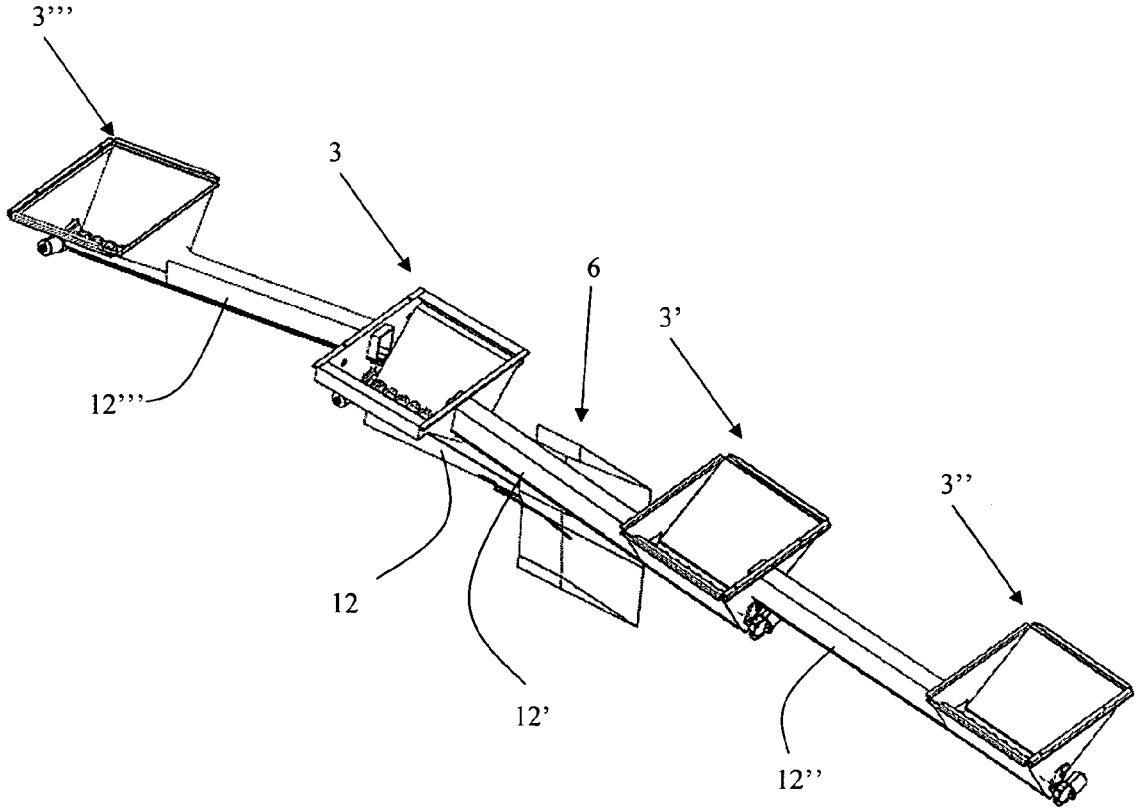
FIG. 10 shows an isometric view of an alternative embodiment.

FIG. 10 shows an alternative embodiment of the invention. To increase the capacity of the ice distribution apparatus further ice makers may be provided (not shown). Below each further ice maker further ice collecting zones 3'', 3''' are provided adjacent to and in communication with the first and/or second ice collecting zones 3, 3' by upwardly directed ice transport means 12', 12'', 12'''. All ice is conveyed to and collected in the first ice collecting zone 3 before being conveyed to the ice bagging 6 by the first ice transport means 12 and dispensed into the bag. All ice collecting zones share the same ice bagging zone 6.

The invention claimed is:

1. An ice bagging apparatus comprising:

a) a frame, b) a first ice collecting zone within said frame comprising a collecting bin;

c) an ice bagging zone within said frame comprising i) a film feeding mechanism for conveying two superposed heat-sealable elongated film webs of plastic from a film web stock according to a conveying direction, and ii) a welding apparatus for joining said two film webs to form a bag, d) a first ice transport system within said frame, having an inlet opening in the first ice collecting zone and an outlet opening in the ice bagging zone and positioned between the two film webs above the formed bag, e) a measuring arrangement within said frame for measuring the amount of ice dispensed into the bag by the first ice transport system, wherein the film feeding mechanism comprises a pair of rollers between which the film webs are passed, means for pressing the rollers against each other for retaining the film webs there between, and a film feeding motor operationally connected to at least one of the rollers, and wherein the measuring arrangement comprises a weighing scale which includes a base and a weighing pan, wherein the base is attached to the frame, and wherein the pair of rollers are suspended from the weighing pan.

2. An ice bagging apparatus according to claim 1, wherein the first ice transport system comprise a chute, a drive spring positioned inside said chute along the axis thereof, and an drive spring drive motor.

3. An ice bagging apparatus according to claim 2, wherein the drive spring is a helical spring.

4. An ice bagging apparatus according to claim 2, wherein at least one drain opening is formed at substantially the lowest position of the chute, and wherein a drip pan is provided underneath said at least one drain opening.

5. An ice bagging apparatus according to claim 1, wherein the welding apparatus comprise means for performing thermal sealing, the means being disposed at a position after the rollers as seen in the conveying direction of the film webs.

6. An ice bagging apparatus according to claim 1, wherein the welding apparatus comprises means of thermal sealing on the film webs both in direction across and along the conveying direction.

7. An ice bagging apparatus according to claim 1, wherein the welding apparatus comprises means for separating the ice filled bag from the film webs.

8. An ice bagging apparatus according to claim 1, wherein the measuring arrangement comprise a strain gauge scale which is interconnected between the frame and the pair of rollers.

9. An ice bagging apparatus according to claim 1, wherein the first ice transport system is a downwardly directional ice transport system.

10. An ice bagging apparatus comprising:

a) a first ice collecting zone comprising a first collecting bin;

b) a second ice collecting zone comprising a second collecting bin;

c) an ice bagging zone comprising i) a film feeding mechanism for conveying two superposed heat-sealable elongated webs of film from a film stock according to a conveying direction, and ii) a welding apparatus for joining said two film webs to form a bag, d) a first ice transport system, having an inlet opening in the first ice collecting zone and an outlet opening in the ice bagging zone and positioned between the two webs of film above the formed bag, e) a second ice transport system, having an inlet opening in the second ice collecting zone and an outlet opening in first collection zone, and f) a measuring arrangement for measuring the amount of ice dispensed into the bag by the first ice transport system, wherein the film feeding mechanism comprises a pair of rollers between which the film webs are passed, means for pressing the rollers against each other for retaining the film webs there between, and film feeding motor operationally connected to at least one of the rollers, and wherein the measuring arrangement comprises a weighing scale which includes a base and a weighing pan, wherein the base is attached to the frame, and wherein the pair of rollers are suspended from the weighing pan.

11. An ice bagging apparatus according to claim 10, wherein the first and/or second ice transport system comprise a chute, a drive spring positioned inside said chute along the axis thereof, and an drive spring drive motor.

12. An ice bagging apparatus according to claim 11, wherein the drive spring is a helical spring.

13. An ice bagging apparatus according to claim 11, wherein at least one drain opening is formed at substantially the lowest position of the chute, and wherein a drip pan is provided underneath said at least one opening.

14. An ice bagging apparatus according to claim 10, wherein the welding apparatus comprise means for performing thermal sealing, the means being disposed at a position after the rollers as seen in the conveying direction of the film webs.

15. An ice bagging apparatus according to claim 10, wherein the welding apparatus comprises means of thermal sealing on the film webs both in direction across and along the conveying direction.

16. An ice bagging apparatus according to claim 10, wherein the welding apparatus comprises means for separating the ice filled bag from the film webs.

17. An ice bagging apparatus according to claim 10, wherein the measuring arrangement comprise a strain gauge scale which is interconnected between the frame and the pair of rollers.

18. An ice bagging apparatus according to claim 10, wherein the first ice transport system is a downwardly directional ice transport system.

19. An ice bagging apparatus according to claim 10, wherein the second ice transport system is an upwardly directional ice transport system.

* * * * *